US005895673A

United States Patent [19]

Keough et al.

[11] Patent Number: 5,895,673

[45] Date of Patent: *Apr. 20, 1999

[54] SNACK FOOD DISPENSING UTENSIL

[76] Inventors: Alice Marisha Keough; Katherine Axia Keough; Steven Joseph Keough, all of 15172 Afton Hills Dr., Afton, Minn. 55001

[ * ] Notice: This patent issued on a continued prosecution application filed under 37 CFR 1.53(d), and is subject to the twenty year patent term provisions of 35 U.S.C. 154(a)(2).

[21] Appl. No.: 08/739,807

[22] Filed: Oct. 30, 1996

[51] Int. Cl.[6] ..... A23P 1/08

[52] U.S. Cl. ..... 426/90; 426/91; 426/104; 426/134

[58] Field of Search ..... 426/91, 104, 134, 426/90

[56] References Cited

U.S. PATENT DOCUMENTS

| | | | |
|---|---|---|---|
| 1,947,010 | 2/1934 | Jones | 426/91 |
| 3,384,495 | 5/1968 | Potter | 426/104 |
| 5,370,884 | 12/1994 | Coleman | 426/134 |

*Primary Examiner*—Helen Pratt
*Attorney, Agent, or Firm*—Patterson & Keough, P.A.

[57] ABSTRACT

A food utensil which is useful for picking up and delivering food to a mouth of a consumer comprises a gripping portion and a food adhering portion. The gripping portions allows a consumer to hold the utensil. The food-adhering portion adheres food thereto and provides enough surface adhesion to attract and nominally retain food having a residue which would otherwise be deposited onto the consumer's hands.

21 Claims, 4 Drawing Sheets

SNACK FOOD DISPENSING UTENSIL

FIELD OF THE INVENTION

The invention relates to improved devices for dispensing snack foods, and more particularly to an improved utensil for dispensing popped popcorn.

BACKGROUND OF THE INVENTION

When eating popcorn or certain other foods having oils or other external residue, the consumer usually utilizes his/her fingers to transport the popcorn from its container to the consumer's mouth. When the popcorn is seasoned, for example with cheese seasoning or butter and salt, the seasoning and certain oils come off the popcorn onto the consumer's fingers, resulting in messy fingers, which must be frequently cleaned or wiped before touching clothing, furniture or handling other objects without spreading or smearing this residue onto these objects. This invention overcomes this problem.

SUMMARY OF THE INVENTION

The invention comprises a food utensil for picking up and delivering certain foods having external residue to the mouth of a consumer without leaving that residue on the hands of the consumer. The utensil comprises a gripping portion for allowing a consumer to hold the utensil, and a food adhering section. This section is connected to the gripping portion and provides enough surface adhesion to attract and nominally retain food having a residue which would otherwise be deposited onto the consumer's hands.

DETAILED DESCRIPTION OF THE INVENTION

An advantage of the present invention is to eliminate the need for a consumer to directly utilize his/her fingers when consuming snack foods such as popcorn or other products, thereby freeing the consumer to pursue other activities, which require touching objects and which the consumer desires to touch without soiling the objects with food residue.

Figure 1:
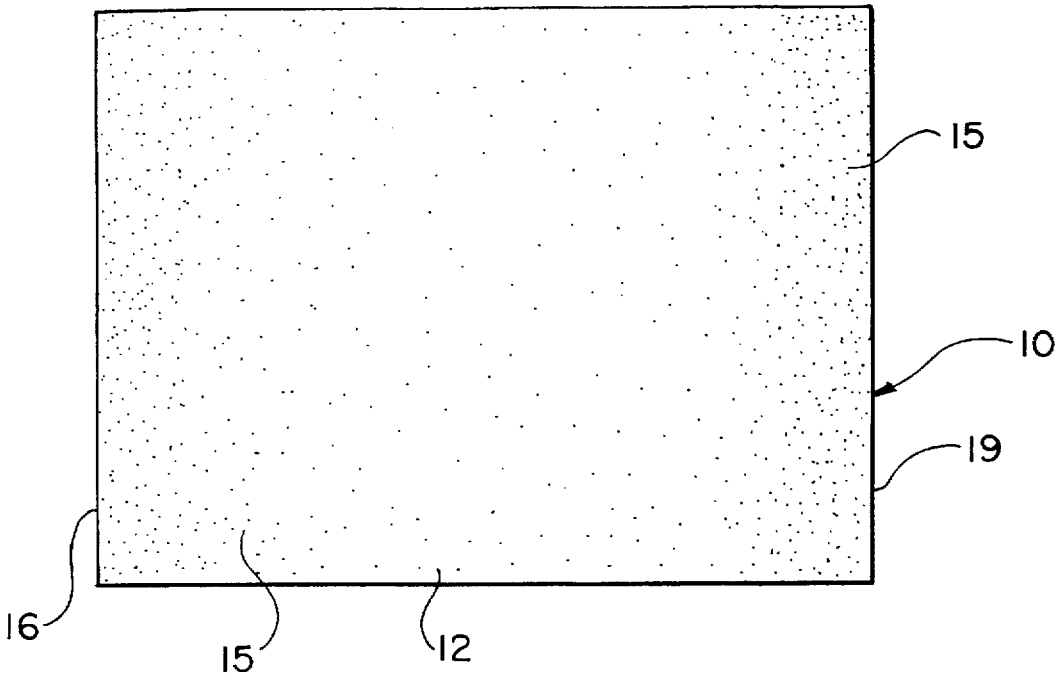
FIG. 1 is a top plan view of a flat version of the invention.
Figure 2:
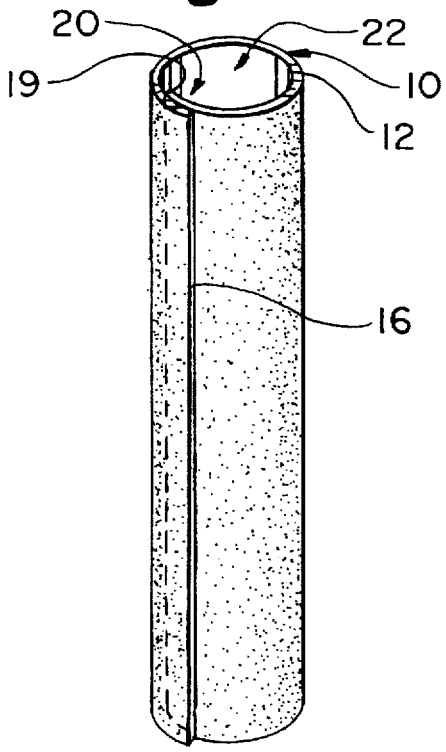
FIG. 2 is a perspective view of a cylindrically-shaped embodiment of the invention.

FIG. 1 is a plan view of a snack food dispensing apparatus or utensil 10. In this embodiment, utensil 10 is formed of a flat material 12 which may be formed into other shapes, including an elongate shape, as shown in FIG. 2. In some embodiments, material 12 may be finally formed as a substantially flat shape or as more of a three-dimensional object, e.g. a cylindrical, spherical or other complex form. Material 12 may be of a plastic or paper composition, and may be in the form of a sheet prior to forming the cylindrical shape. Other materials (both inedible and edible) and shapes are contemplated within this invention, and such shapes may optionally be advantageously initially formed as a sheet, but are generally preferred as resilient or flexible materials.

In the embodiment of FIG. 1, material 12 has been prepared, through coating, deposition, or other treatment, with an adhesion means. Such treatment may be uniform or non-uniform on various portions of each utensil. In this embodiment, adhesion means 15 is an adhesive or otherwise tacky substance. Various characteristics of this material or structure are described below, but a general feature which is desired is that adhesion means 15 must provide enough adhesion to pick up and retain certain food products having external residue adequate to move those products from a serving location to a consumer's mouth.

As shown in FIG. 2, material 12 has been shaped as a cylinder with the two ends 16, 19 optionally overlapped as shown generally at 20 and affixed to each other by any of various attaching means including but not limited to stapling, gluing or other adhesive technique. Adhesion means 15 is applied to a portion of the material 12 such that a portion of the apparatus is left free of the adhesive, thereby defining gripping means, which in some embodiments comprises a handle portion.

Figure 3:
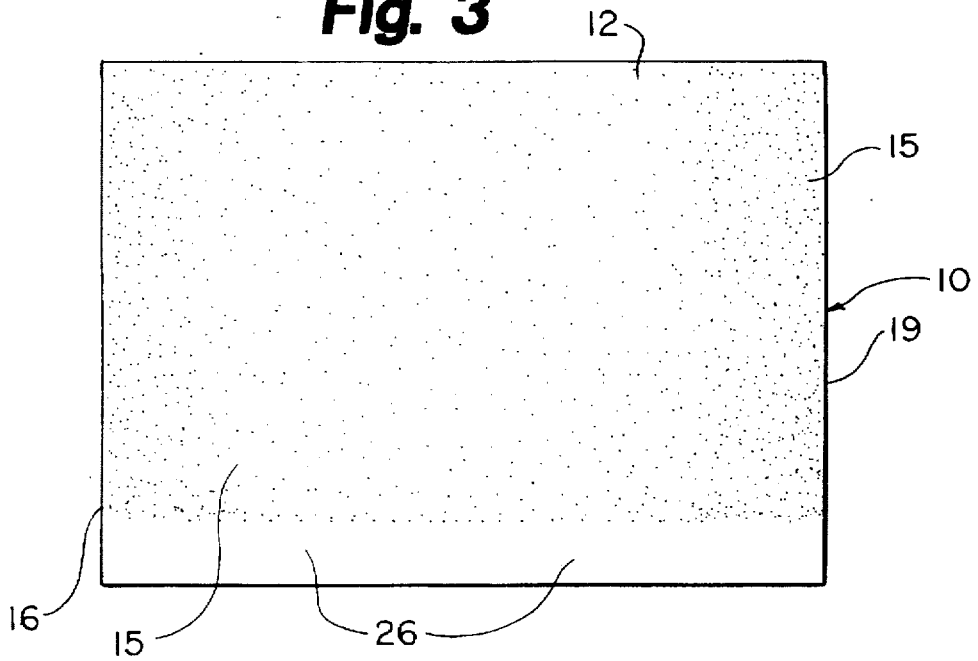
FIG. 3 is a top plan view of another embodiment of a flat version of the invention.
Figure 5:
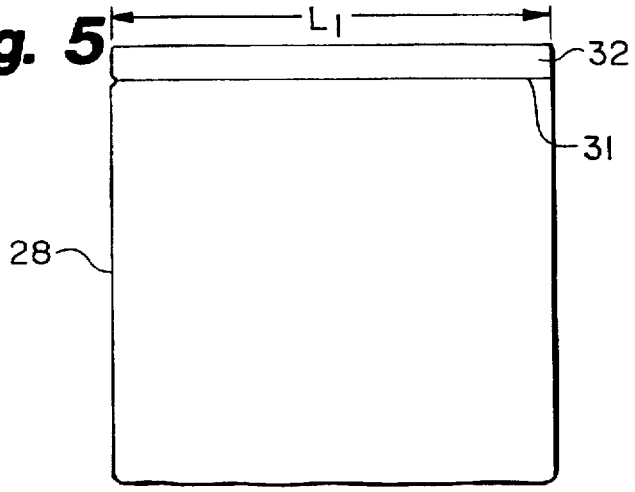
FIG. 5 is a front elevation schematic view of a food package incorporating an embodiment of the invention.
Figure 4:
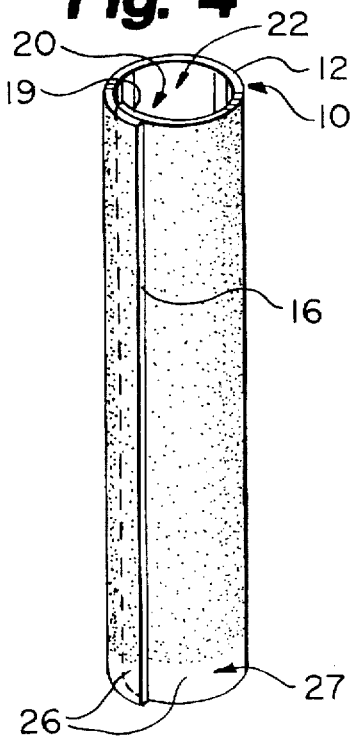
FIG. 4 is a perspective view of another embodiment of a cylindrically-shaped design of the invention.
Figure 6:
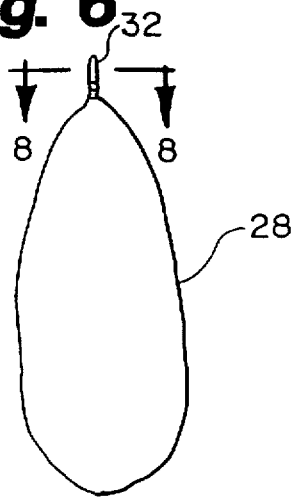
FIG. 6 is a side elevation view of the package shown in FIG. 5.

FIGS. 3 and 4 are substantially similar to FIGS. 1 and 2, but with a different pattern of adhesion means 15. FIGS. 1 and 2 have substantially all of at least one facing surface coated or treated with an adhesive-like material for picking up the food according to the objects of this invention. Accordingly, the embodiment of FIGS. 1 and 2 may be best utilized by inserting one or more user's fingers into the internal area 22 within the cylindrically, or otherwise, shaped walls formed by material 12. In this manner, utensil 10 is readily used without getting any adhesion means in contact with the user's hands. Also, such use allows the consumer of the food to enjoy the tactile pleasure of using his or her fingers while eating certain foods—which is intended for those foods, and which is not likely to be replicated in satisfaction by mere use of a spoon, fork, prong, or other common utensil. Alternately, FIGS. 3 and 4 disclose a zone 26 of material 12 within which there is no adhesion means 15. This results in creation of a gripping portion 27, which is shown in FIG. 4, that is external of the walls formed by the shaped material 12. In one embodiment, apparatus 10 is about four to six inches in length and has a diameter of one-quarter to three inches. It is recognized, however, that various lengths, sizes and shapes are contemplated within the scope of this invention. It is also further recognized that it is desirable and advantageous to create utensils according to this invention which are inexpensive, environmentally degradable with ease, and therefor discardable after use, although these features are not mandatory in all embodiments.

In use, the consumer grasps the apparatus by a gripping means, such as a handle or gripping portion, and positions the adhesively configured portion into contact with the food to be eaten. For example, a user may thrust the apparatus into a container of popped popcorn or roll the apparatus on the surface of a mass of popped popcorn, thereby contacting the popped popcorn with the adhesive means 15, causing the popcorn to adhere to the apparatus. The consumer then brings the apparatus with adhered food to his mouth and consumes the food without directly touching the food with his fingers. By use of apparatus 10, the consumer enjoys the ease of such food without the burden of messy food residue on the consumer's hands. Indeed, in its various configurations, apparatus 10 may be so enjoyable and appealing to consumers as to evolve into a much desired snack food utensil. Accordingly, apparatus 10 may comprise a flexible, conformable substrate which is readily packaged with or integral to a portion of either a soft or hard packaging enclosure suitable for the food carried within.

Figure 7:
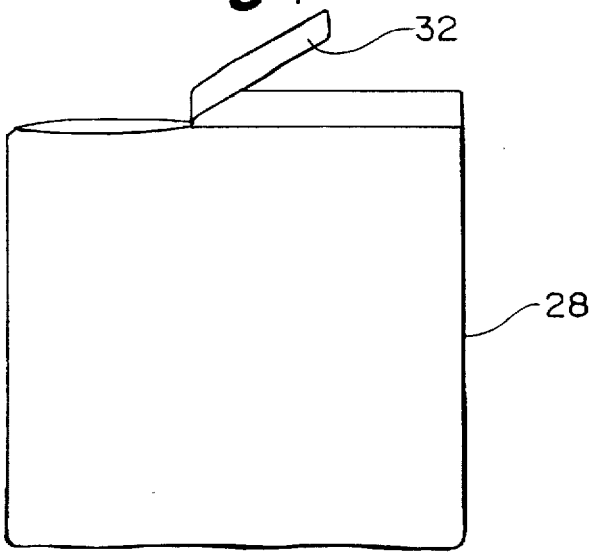
FIG. 7 is a front elevation view of a partially opened food package such as that shown in FIG. 5.
Figure 8:
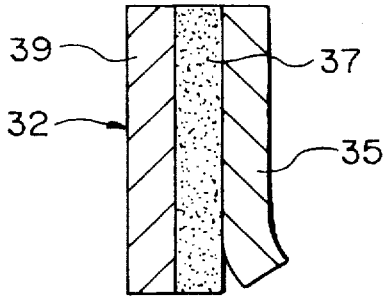
FIG. 8 is a schematic sectional view of the portion of the package shown in FIG. 6 between lines 8—8.

In one embodiment, apparatus 10 is a conformable elongate shape with a portion suitable for attracting and temporarily retaining the edible food products, and another portion for holding with a user's hand or fingers. Such an embodiment is quite compatible with a soft package or container, such as a thin polymer sack or paper bag for use with popcorn or other foods which might impart a residue to the user's fingers. Apparatus 10 may be manufactured as an integral part of a packaging container 28, such as a seam 31 or tab 32 as shown by way of example in FIGS. 5–8. In such an embodiment, it may be possible to utilize a portion of the package which, when opened, would otherwise be discarded as the portion having the properties of this invention. Such use minimizes package waste and optimizes packaging utility. A cover strip 35 or other removable protective covering of material may be advantageously used with the dispensing or utensil apparatus of this invention. As shown in FIGS. 7 and 8, after tab 32 is removed from packaging container 28 to allow access to the contents of food therein, the tab 32 itself is further utilized. In FIG. 8, one embodiment of the tab 32 comprises multiple layers of material suitable for the various requirements of the tab life cycle, e.g. strength and sealing characteristics as a portion of the package, but having removable layers after the package has been opened by removal of the tab. For example, in FIG. 8, layer 35 is another tab layer that may be removed from an inner adhesively configured layer 37. Removal of layer 35 is facilitated by the entire removal of tab 32 across length $L_1$ from the package. Then the exposure of sticky or tacky layer 37, mounted to pliable substrate 39 enables the ultimate user of this product to easily employ all or part of the tab in various configurations and lengths as a utensil for collecting volumes of sticky food objects, and then eating them with little mess.

Apparatus 10 could also be made of a simple plastic material or be comprised of a hollow ceramic core, with both the plastic and ceramic embodiments having or lacking end caps. Alternatively, if end caps are present, they may also be coated or treated with adhesion means. Apparatus 10 itself could also be made of an edible material such as a pressed fruit or vegetable, corn or maize masa, corn grits, corn flakes, puffed corn collets, or other processed food materials. In the example of corn or maize masa, such materials are baked then fried into a hollow cylindrical configuration in a similar fashion as when taco shells are made, except that the masa is formed into squares or rectangles, positioned on a conveyer, and with two opposite sides overlapped to form a hollow cylinder (or made in other shapes) and then heated in an oven, thereby fixing the desired shape. The resulting products are then deposited into a cooking oil and fried. This general baking technique is known in the art and is also taught in *Corn: Chemistry and Technology* (Rooney, Lloyd W. and Sergio O. Serna-Saldivar, "Food Uses of Whole Corn and Dry-Milled Fractions" in: Watson, S. A. and P. E. Ramstad, *Corn; Chemistry and Technology*, (St. Paul, Minn., American Association of Cereal Chemists, 1987)).

Adhesion means 15 is preferably of a material which retains or holds fully suspended food adjacent utensil 10 for at least 3 seconds, and in some embodiments for a longer period of time. Such an adhesive coating may be comprised of various edible or non-edible coatings known in the adhesive or food industries, such as a corn syrup, honey, or other syrups or coating compositions which have the desirable characteristics according to this invention. The tackiness of any adhesive coating can vary, but is particularly designed to enable the consumer to pick up buttered, salted or otherwise seasoned popcorn or various other foods from a container and then transfer the food to the consumer's mouth without the food falling from the apparatus before being consumed. It is recognized that one or more embodiments may be necessary in order to attract, retain and dispense different snack foods and edible items which might otherwise impart undesired residue on a consumer's hands.

An adhesive material or coating could be edible and have a seasoning within, thereby itself imparting a taste so as to enhance the taste of the seasoned popcorn or other food. Such an embodiment of adhesive material coating, which imparts a taste to the consumer when the popcorn and a portion of adhesive coating 25 is eaten, could eliminate the need to season the popcorn or other food prior to consumption or could further enhance or complement the savory properties of such food with a separate taste from such a coating. Such seasonings as salt, cheddar cheese, swiss cheese, nacho, butter, sour cream, soy, and numerous others are examples of tastes which may be incorporated within this embodiment. These and other seasonings are known within the food industry, but have not previously been utilized in this manner. Another example of an adhesive coating embodiment for utensil 10, and method of use within this invention, is a sucrose- or fructose-based substance, optionally with vanilla as the seasoning, which is reasonably hard and is not tacky at room temperatures. This is used to make certain snack foods known in the food industry. Use of such substance, or similar substance, in accordance with this invention may include heating in a regular or convection oven or microwave oven. The adhesive substance would then soften and become sticky or tacky and, thereby become useful for picking up popcorn from a container and subsequent consumption.

Figure 9:
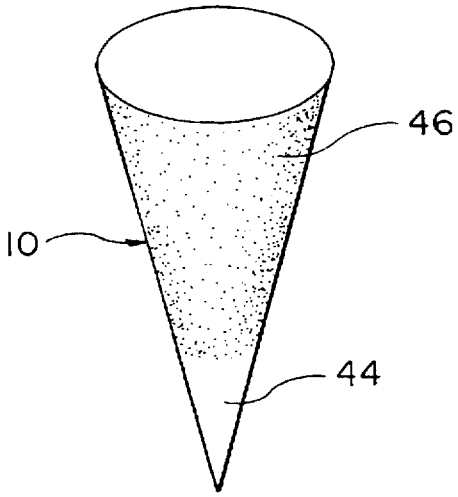
FIG. 9 is a partial perspective view of a conical embodiment of the invention.

Various shapes of utensil 10 are contemplated, with further examples shown below. FIG. 9 shows a cone-shaped utensil 10 with a gripping portion 44 and a food adhering portion 46. It is recognized that a utensil may alternatively employ the pointed end portion as the food adhering portion, and that one or more projections may be useful depending on the application.

Figure 10:
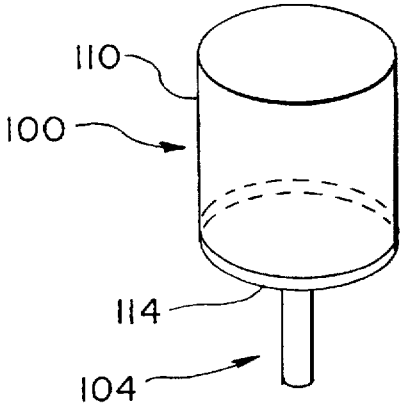
FIG. 10 is a partial perspective view of a re-useable cylindrical embodiment of the invention.

FIG. 10 is another embodiment of the present invention in a cylindrical configuration. This embodiment comprises utensil 100 having, optionally, a non-edible holder 104. An edible or merely disposable material 110, such as one of those discussed with respect to the above figures, is formed into a hollow cylinder or cone and is coated or treated with adhesion means as disclosed above. The resulting coated cylinder is positioned within a rim 114 of holder 104. The diameter of the inside of rim 114 and the diameter of the outside of the coated cylinder 110 are such that a snug fit is achieved and that the coated cylinder does not easily fall from the holder during use. Of course, other means for connecting the two elements are possible. After being used to pick up the food, the coated cylinder can then be consumed or discarded. Handle 104 can then be reused with another coated cylinder as desired.

Figure 11:
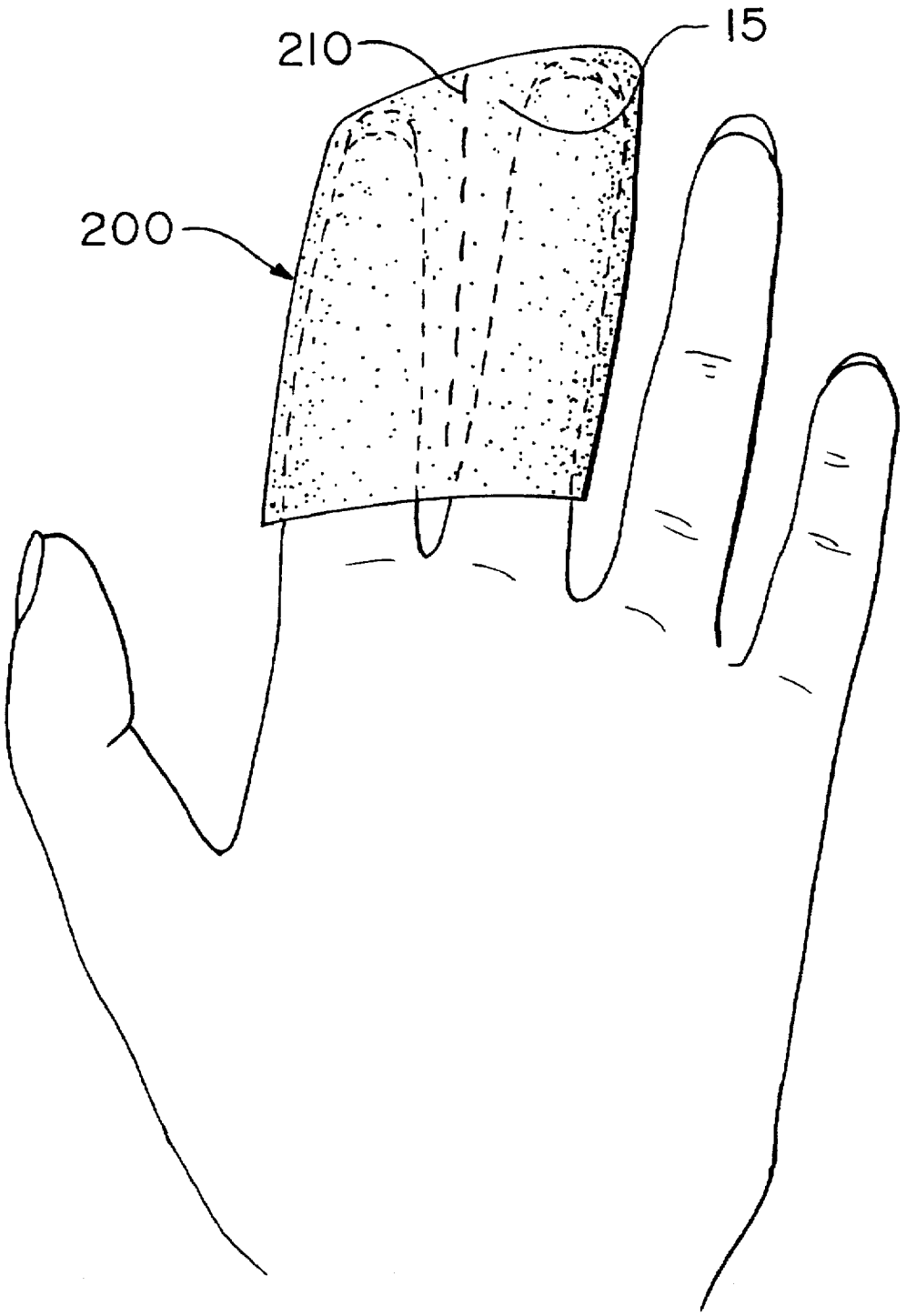
FIG. 11 is an elevation view of a user's hand with a conformable embodiment of the invention.

It is recognized that various shapes of utensils are possible within this invention, including highly flexible finger wraps 200 as shown in FIG. 11. In this embodiment, as in the utensil 10 shown in FIGS. 2 and 4, it is possible for the user to insert her fingers within the utensil in order to manipulate it. Utensil 200 is preferably a flexible material possibly even with similar conformable characteristics as that of thin polymer materials, so as to easily follow the movements of a user's fingers. Food adhering means 15 is exposed for contacting the food to be eaten. As shown, utensil 200 may be optionally packaged with perforated or convenient separation and sizing other means 210 to select different sizes for use with one or more fingers.

While the embodiments depicted and described herein are with respect to the consumption of popped popcorn, it is recognized that this invention is entirely suitable of facilitating the consumption of other food items as well. Suitable food items for consumption include: puffed snacks; items which have been roasted, salted or seasoned, such as honey roasted pecans, walnuts, hazelnuts, peanuts, sunflower meats, or soybeans; cheese or cheese-coated products; and other products in which the consumer desires to avoid having seasoning or natural oils on her fingers while consuming them.

Changes and modifications in the specifically described embodiments can be carried out without departing from the scope of the invention which is intended to be limited only by the scope of the claims thereof.

What is claimed is:

1. A food utensil useful for picking up and delivering food to a mouth of a consumer, the utensil comprising:

a) gripping means for allowing a consumer to hold the utensil;

b) food adhering means for adhering food thereto, the food adhering means being connected to the gripping means and providing enough surface adhesion to attract and nominally retain food having a residue which would otherwise be deposited onto the consumer's hands; said food adhering means being substantially co-planar with said gripping means.

2. The utensil of claim 1 in which the food adhering means is edible.

3. The utensil of claim 1 in which the food adhering means is partially edible.

4. The utensil of claim 1 in which the food adhering means is a coating on a portion of the utensil.

5. The utensil of claim 1 in which the entire utensil is edible.

6. The utensil of claim 1 in which the food adhering means is flavored.

7. The utensil of claim 1 in which a portion of the food utensil is pliable.

8. The utensil of claim 1 in which the adhesion of the food adhering means supports a food portion using only adhesion for at least three seconds.

9. The utensil of claim 1 in which the gripping means comprises surfaces internal to a portion of the utensil.

10. The utensil of claim 9 in which the internal surfaces are shaped for slidable fit over one or more of the user's fingers.

11. The utensil of claim 1 in which the food adhering means comprises surfaces which are external portions of surfaces comprising the gripping means.

12. A food utensil useful for picking up and delivering certain oily or powdered food products to a mouth of a consumer without the food contacting the consumer's hands, the utensil comprising:

a) gripping means for allowing a consumer to hold the utensil;

b) edible food adhering means for adhering food thereto, the food adhering means being connected to the gripping means and providing enough surface adhesion to attract and nominally retain food having a residue which would otherwise be deposited onto the consumer's hands; said food adhering means being substantially co-planar with said gripping means.

13. The utensil of claim 12 in which the edible food adhering means is a coating on a portion of the utensil.

14. The utensil of claim 12 in which the food adhering means is flavored.

15. The utensil of claim 12 in which a portion of the food utensil is pliable.

16. The utensil of claim 12 in which the adhesion of the food adhering means supports a food portion using only adhesion for at least three seconds.

17. The utensil of claim 12 in which the gripping means comprises surfaces internal to a portion of the utensil.

18. The utensil of claim 17 in which the internal surfaces are shaped for slidable fit over one or more of the user's fingers.

19. The utensil of claim 12 in which the food adhering means comprises surfaces which are external portions of surfaces comprising the gripping means.

20. A food utensil useful for picking up and delivering food to a mouth of a consumer, the utensil comprising:

a) gripping means for allowing a consumer to hold the utensil;

b) food adhering means for adhering food thereto, the food adhering means being connected to the gripping means and providing enough surface adhesion to attract and nominally retain food having a residue which would otherwise be deposited onto the consumer's hands; said food adhering means comprising a base surface and a food adhering coating on a first side of said base surface.

21. The utensil of claim 20 in which said base surface comprises a second side, said base surface second side comprising said gripping means.

* * * * *